US007937790B2

(12) United States Patent
Zhao et al.

(10) Patent No.: US 7,937,790 B2
(45) Date of Patent: May 10, 2011

(54) DIAPER CHANGER

(75) Inventors: Guang-Hui Zhao, Taipei (TW); Hong-Bin Xu, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 0 days.

(21) Appl. No.: 12/196,295

(22) Filed: Aug. 22, 2008

(65) Prior Publication Data

US 2009/0049606 A1 Feb. 26, 2009

Related U.S. Application Data

(60) Provisional application No. 60/957,171, filed on Aug. 22, 2007.

(51) Int. Cl.
*A47C 16/00* (2006.01)

(52) U.S. Cl. ..... 5/655; 5/507.1

(58) Field of Classification Search ..... 5/655, 658, 5/93.1, 99.1, 507.1
See application file for complete search history.

(56) References Cited

U.S. PATENT DOCUMENTS

| | | | | |
|---|---|---|---|---|
| 2,851,700 | A * | 9/1958 | Denison | 5/93.1 |
| 3,054,122 | A * | 9/1962 | Sarkus | 108/49 |
| 5,359,741 | A * | 11/1994 | Lang | 5/507.1 |
| 5,845,348 | A * | 12/1998 | Dunn et al. | 5/83.1 |
| 6,948,197 | B1 * | 9/2005 | Chen | 5/93.1 |
| 2005/0150053 | A1 * | 7/2005 | Hartenstine | 5/655 |

* cited by examiner

*Primary Examiner* — Fredrick Conley
(74) *Attorney, Agent, or Firm* — Winston Hsu; Scott Margo

(57) ABSTRACT

Rotation device is configured at the bottom of the body of a diaper changer so that the diaper changer is capable of rotating horizontally relative to the playard frame via the rotation device when mounting thereon. The rotation device includes a rotator and a supporter where the rotator connects to the body and mounts on the supporter for allowing the body to rotate relative to the supporter. The supporter is further configured at one side of the playard frame. The body can also be rotatably mounted on the playard frame by mounted the rotator directly into a shafting hole on the playard frame. With the rotation device, the diaper changer can be selectively set in a first using status for changing a baby's diaper or a second using status for allowing a babysitter for easy holding the baby up.

20 Claims, 6 Drawing Sheets

DIAPER CHANGER

CROSS REFERENCE TO RELATED APPLICATIONS

This application claims the benefit of U.S. Provisional Application No. 60/957,171, which was filed on Aug. 22, 2007, and is incorporated herein by reference.

BACKGROUND OF THE INVENTION

1. Field of the Invention

The present invention relates to a diaper changer, and more specifically, to a diaper changer capable of rotating horizontally on the playard frame.

2. Description of the Prior Art

Conventional playards usually include a frame where a diaper changer can be mounted thereon for providing a place for changing baby's diaper. The diaper changer usually mounts on one side of the frame providing position that the baby lies with its feet facing forward the babysitter for convenient diaper changing. Such diaper changer, however, does not provide the ability of horizontal rotation on the frame. The babysitter should hold up the baby by using twisting posture or has to walk to the next side of the frame in order to easily hold up the baby.

SUMMARY OF THE INVENTION

The present invention provides a diaper changer for a playard frame. The diaper changer includes a body for supporting a baby and a rotation device connecting to the body. The rotation device is mounted on one side of the playard frame and rotatable along a first direction. The body is capable of selectively set in a first using status or in a second using status relative to the playard frame via the rotation device.

The present invention also provides a playard. The playard includes a playard frame and a diaper changer. The diaper changer includes a body for supporting a baby and a rotation device connecting to the body. The rotation device is mounted on one side of the playard frame and rotatable along a first direction. The body is capable of selectively set in a first using status or in a second using status relative to the playard frame via the rotation device.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
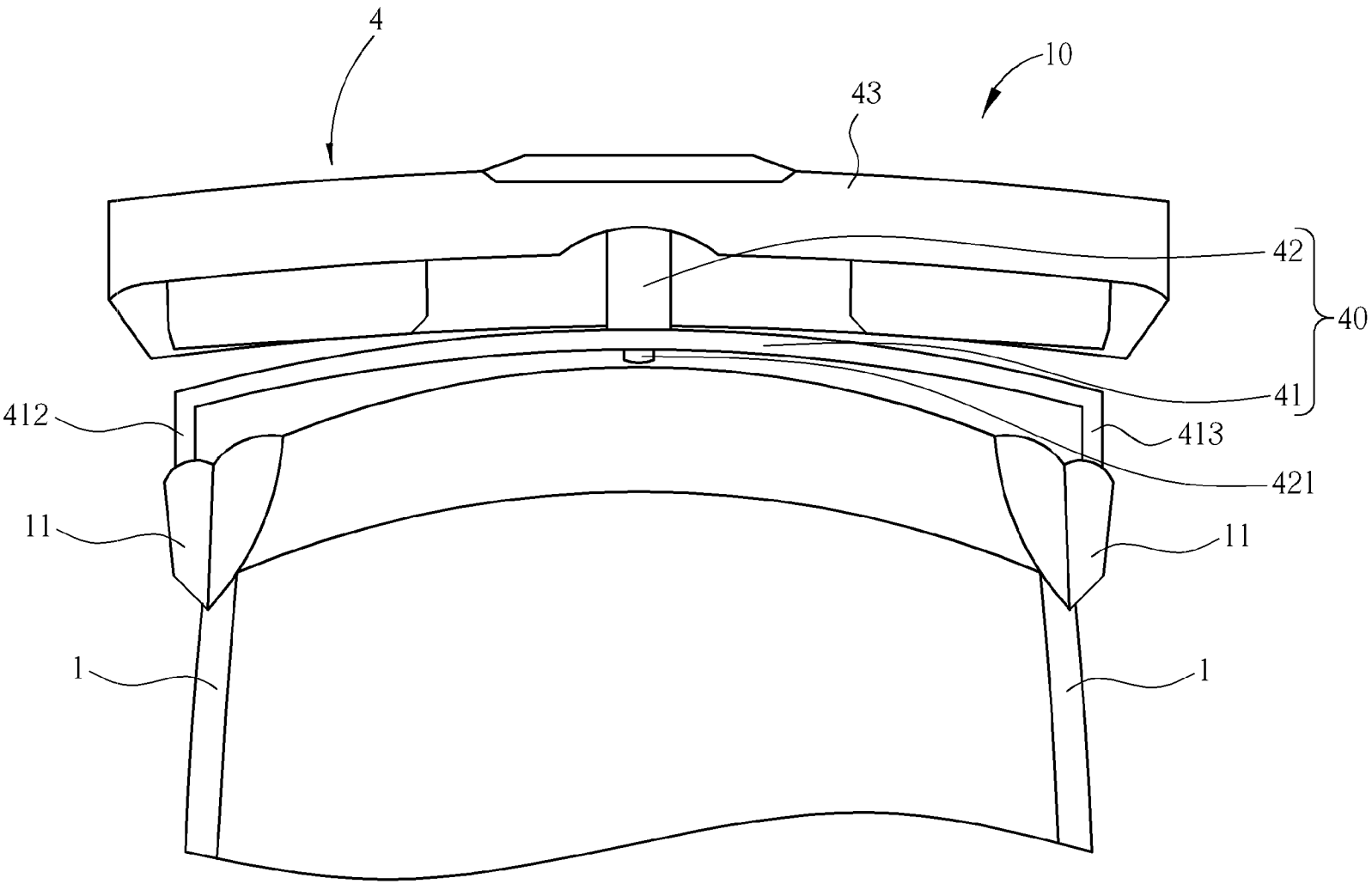
FIG. 1 is a side view illustration of a playard having rotatable diaper changer according to the present invention.
Figure 3:
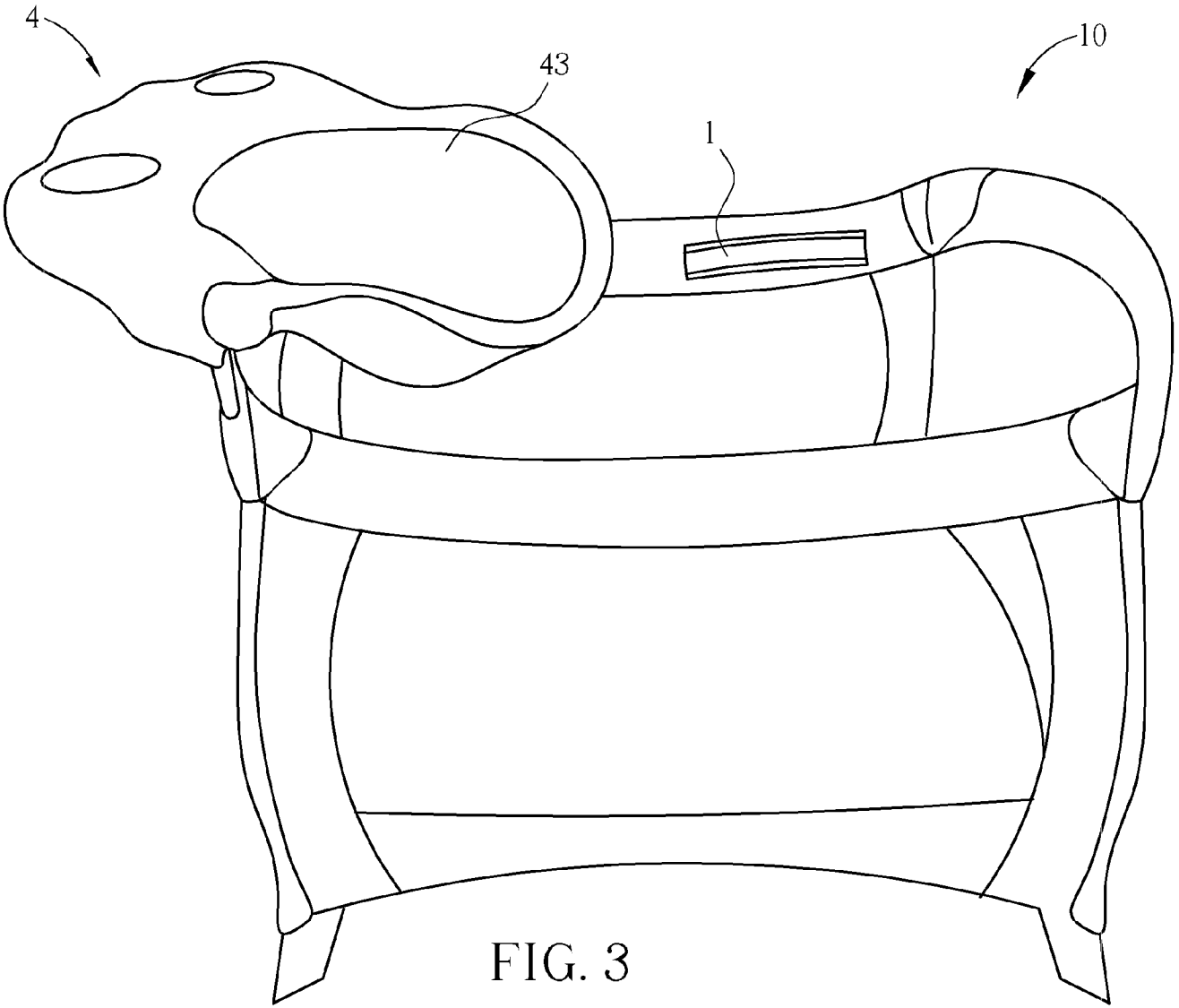
FIG. 3 is an illustration showing the diaper changer set in a first using status on the playard frame.
Figure 4:
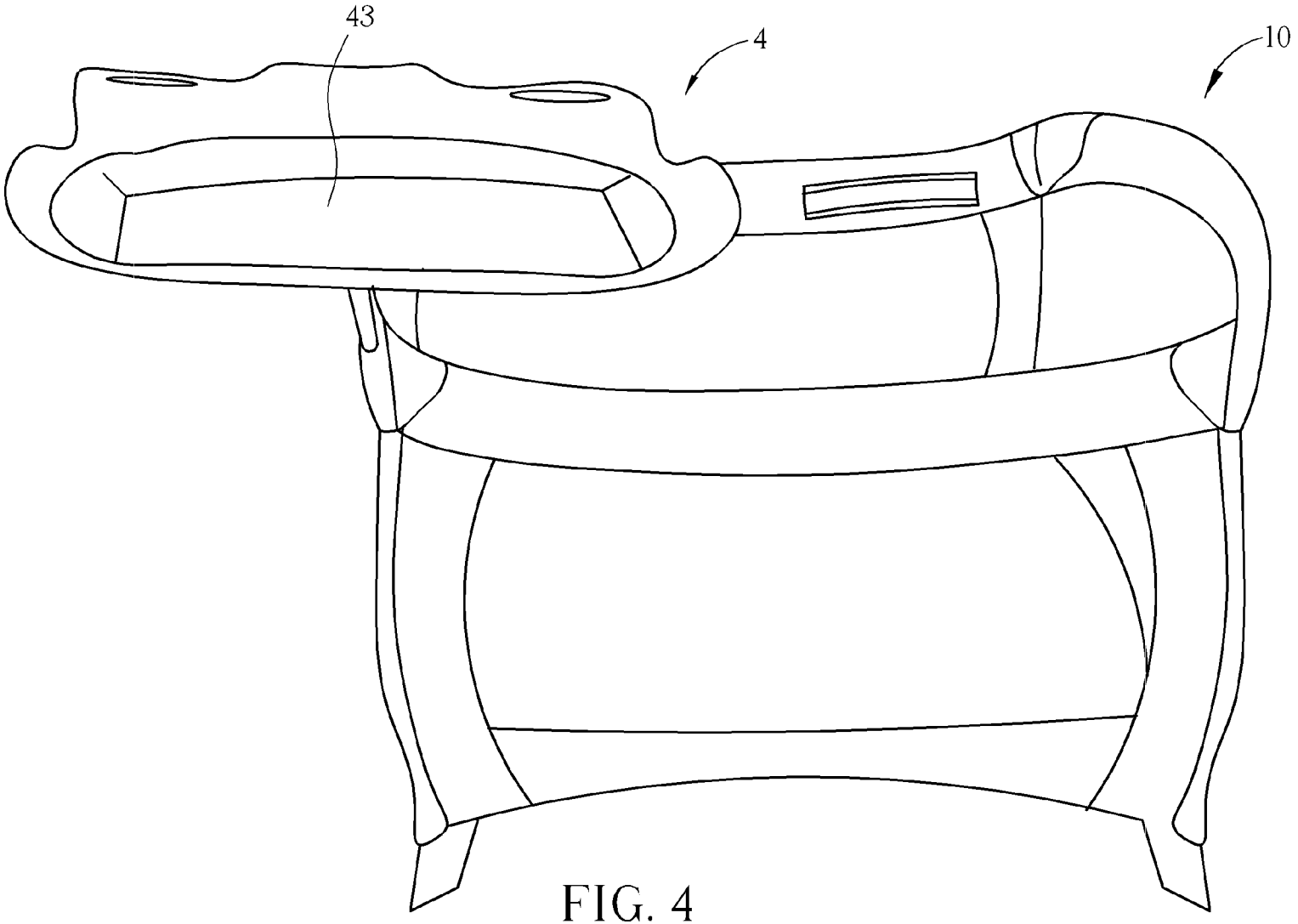
FIG. 4 is an illustration showing the diaper changer set in a second using status after horizontal rotating on the playard frame.

Please refer to FIG. 1. FIG. 1 is a side view illustration of a playard 10 having rotatable diaper changer 4 according to the present invention. The playard 10 includes a playard frame 1 and a diaper changer 4 that is detachably mounted on the playard frame 1. FIG. 1 shows a side view of the playard 10 at the shorter side of the playard 10. The diaper changer 4 includes a body 43 and a rotation device 40, via which the diaper changer 4 can mount on the playard frame 1. The body 43, shown in FIG. 3 and FIG. 4, provides room for a baby lying thereon. In this embodiment, the rotation device 40 includes a supporter 41 and a rotator 42. Please refer to FIG. 2, which is an exploded view illustration of the rotatable diaper changer 4. The rotator 42 connects to the bottom of the body 43 and has a shaft 421. The supporter 41 has a shafting hole 411 at the middle section. The shaft 421 of the rotator 42 is inserted into the shafting hole 411 of the supporter 41 and rotatable within the shafting hole 411 so that the body 43 connected to the rotator 42 is also rotatable relative to the supporter 41. Since in this embodiment and relevant figures, the shafting hole 411 has vertical axle and the shaft 421 vertically inserts into the shafting hole 411, the body 43 therefore rotates relatively to the supporter 41 horizontally.

Figure 2:
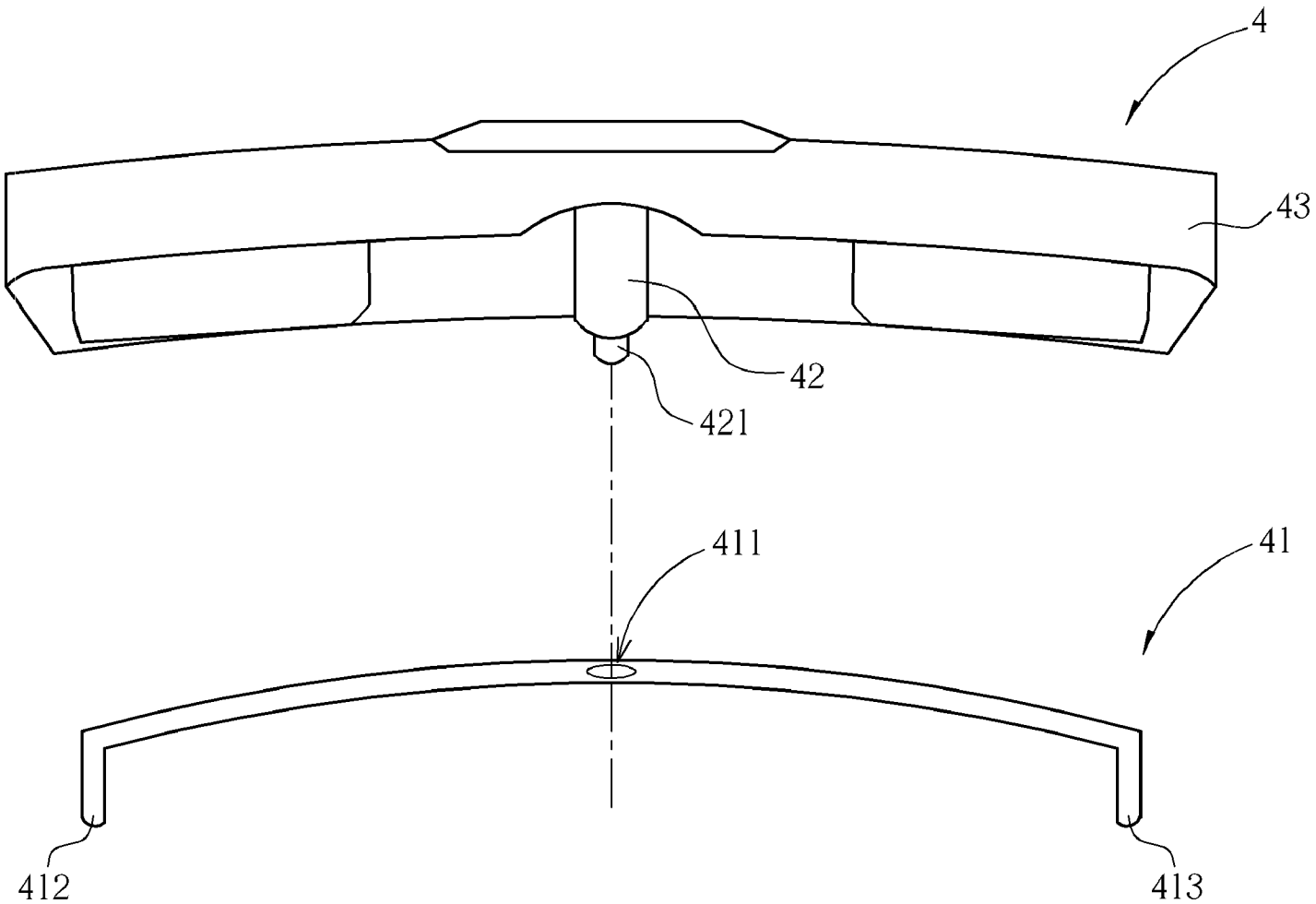
FIG. 2 is an exploded view illustration of the rotatable diaper changer.

Please refer to FIG. 1 and FIG. 2. In this embodiment, the supporter 41 is a pipe and has two coupling ends 412, 413 at two sides for detachably mounting on one side of the playard frame 1. FIG. 1 shows that the coupling ends 412, 413 are inserting into the top corners 11 of the playard frame 1. When the body 43 of the diaper changer 4 rotatably mounts on the supporter 41 via the rotator 42 horizontally, and the supporter 41 then mounts on one side of the playard frame 1, the body 43 can horizontally rotate relative to the side of the playard frame 1 via the shaft 421 of the rotator 42. In this embodiment, the body 43 takes the rotator 42 as the axle to have 90° rotation relative to the playard frame 1.

Please refer to FIG. 3 and FIG. 4. FIG. 3 is an illustration showing the diaper changer 4 set in a first using status on the playard frame 1, and FIG. 4 is an illustration showing the diaper changer 4 set in a second using status after horizontal rotating on the playard frame 1. When a baby lying on the diaper changer 4 set in the first using status as shown in FIG. 3, the baby lies with its two feet facing toward a babysitter so that the babysitter can change the baby's diaper easily. After changing the baby's diaper, the babysitter can rotate the diaper changer 4 horizontally via the rotation device 40 to the second using status as shown in FIG. 4, and the baby now lies laterally toward the babysitter so that the babysitter can easily hold the baby up. During the rotation of the diaper changer 4, either moving from the first using status to the second using status or vice versa, baby lying thereon may not be disturbed.

In addition to the diaper changer 4 described in the previous embodiment, in other embodiment of the present invention, the diaper changer can also be directly mount on the playard frame via the rotator, which, in other word, the supporter can also be part of the playard frame. The shafting hole is on the playard frame and the rotator of the diaper changer has a shaft that rotatably inserts into the shafting hole on the playard frame. The body connected by the rotator can therefore rotate horizontally relative to the playard frame.

Figure 5:
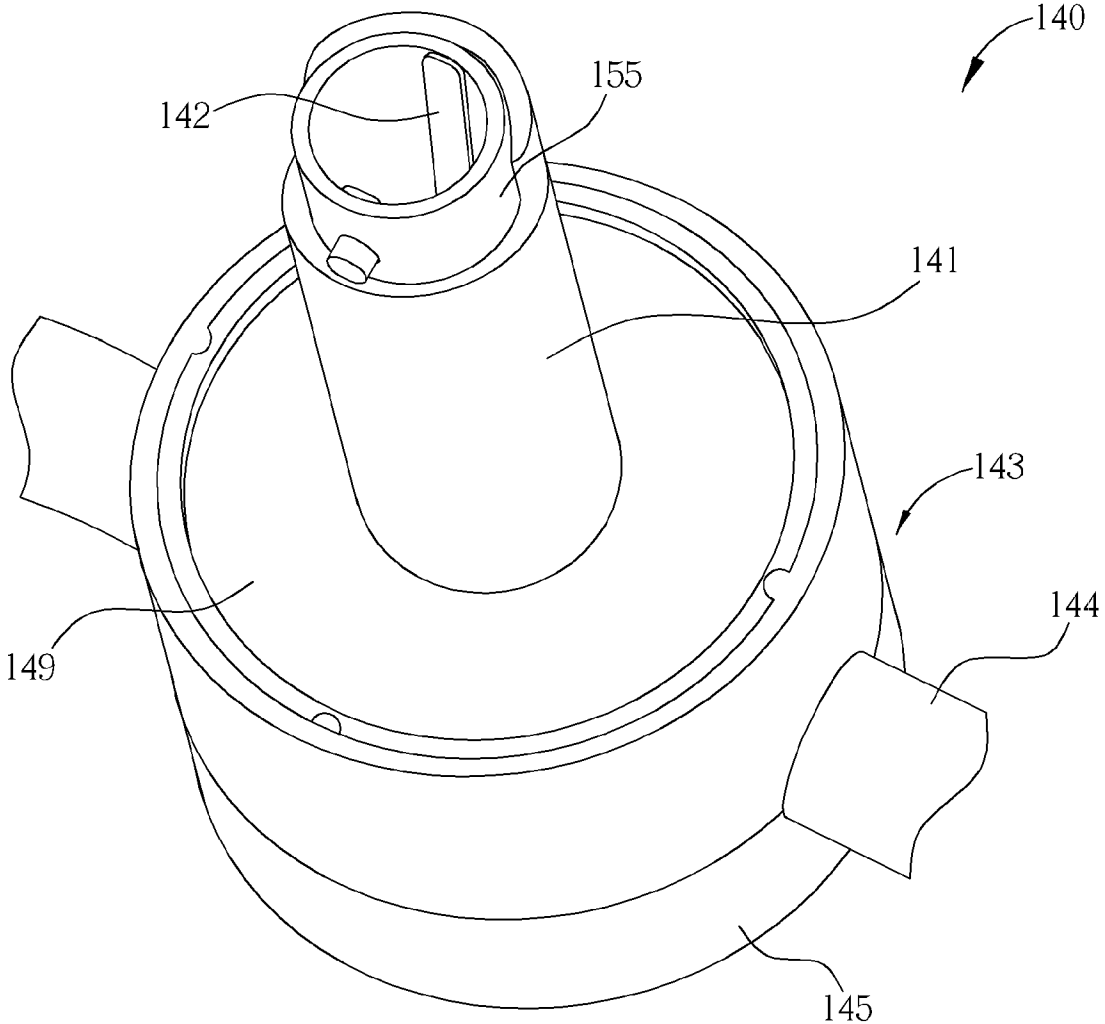
FIG. 5 is an illustration of another embodiment of a rotation device.
Figure 6:
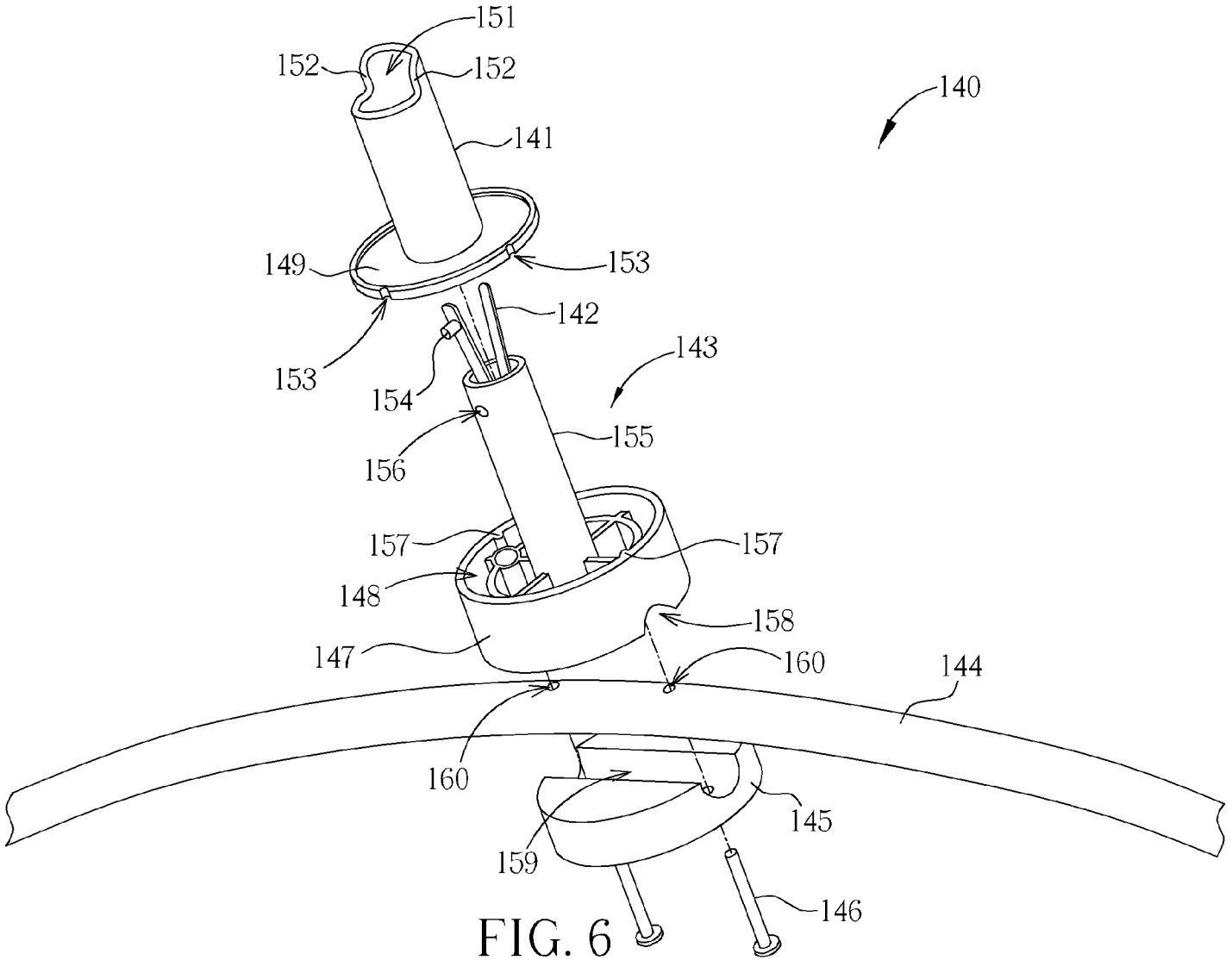
FIG. 6 is an exploded view illustration of the rotation device in FIG. 5.

Please refer to FIG. 5 and FIG. 6. FIG. 5 is an illustration of another embodiment of a rotation device 140 and FIG. 6 is an exploded view illustration of the rotation device 140 in FIG. 5. In the previous embodiments, the shaft 421 of the rotator 42 is directly inserted into the shafting hole 411 of the supporter 41 to enable horizontal rotation of the body 43. The rotation device 140, however, further provides mechanism that can prevent the body 43 from falling off and limit the angle of rotation of the body 43. The rotation device 140 includes a rotator and a supporter. The supporter includes a limiter 142, an upper seat 143, a lower seat 145, a supporting post 144, and a plurality of screws 146. The upper seat 143 includes a coupling portion 147 and a hollow pipe portion 155 that extends upward from the coupling portion 147. The coupling portion 147 is a disk-shaped column having a concave portion 148 on the top surface and forms bulges 157 on the peripheral of the concave portion 148. The coupling portion 147 and the lower seat 145 combine with the supporting post 144 via the first groove 158 and the second groove 159 respectively. The screws 146 pass through the lower seat 145, the installing holes 160 of the supporting post 144, and the upper seat 143 so as to secure the upper seat 143 and the lower seat 145 to the supporting post 144. The supporting post 144 has two coupling ends at two sides, which are not shown in the figure, that can detachably install on the top corners of the playard frame 1. The limiter 142 is placed inside the pipe portion 155 of the upper seat 143. In this embodiment, the limiter 142 is a V-shape elastic element and has a protrusion 154 on its one arm. The protrusion 154 extends from a hole 156 on the wall of the pipe portion 155 while the limiter 142 is placed inside the pipe portion 155. The rotator includes an axle portion 141 fixed to the bottom of the body 43 and a disk 149 mounted at the bottom of the axle portion 141. The axle portion 141 and the disk 149 have a hollow portion 151 that can sleeve on the pipe portion 155 of the upper seat 143. The disk 149 is contained in the concave portion 148 of the upper seat 143 and rotatable thereon. When the axle portion 141 is assembled with the upper seat 143, the protrusion 154 of the limiter 142 inside the upper seat 143 extends out of the hole 156 and abuts against the wall of the axle portion 141 so that axle portion 141 and the body 43 may not remove from the upper seat 143 by pulling upward. The axle portion 141 also includes two abutting portions 152 on it wall. When the axle portion 141 rotates relative to the upper seat 143, the protrusion 154 of the limiter 142 is stopped by the abutting portion 152, and thereby confining the angle of rotation of the body 43 relative to the supporting post 144. In this embodiment, the two abutting portions 152 are spaced to each other around 180° argument so that the body 43 is rotated relative to the supporting post 144 about ±90°.

Additionally, after the axle portion 141 is mounted on the upper seat 143, the disk 149 has a plurality of indentations 153 at the peripheral that can engage with the bulges 157 of the coupling portion 147 so that the body 43 can be positioned while rotating and in this embodiment, the diaper changer 4 can be positioned when it rotates to 90° relative to the playard frame 1.

The playard of the present invention configures the rotation device at the bottom of the body of the diaper changer so that the diaper changer is capable of rotating horizontally relative to the playard frame via the rotation device when mounting thereon. The rotation device includes the rotator and the supporter where the rotator connects to the body and mounts on the supporter for allowing the body to rotate relative to the supporter. The supporter is further configured at one side of the playard frame. The body can also be rotatably mounted on the playard frame by inserting the rotator directly into a shafting hole on the playard frame. With the rotation device, the diaper changer can be selectively set in a first using status for changing a baby's diaper or a second using status for allowing a babysitter for easy holding the baby up.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A diaper changer for a playard frame, comprising:

a body which includes a surface for a baby lying thereon; and a rotation device connecting to the body, the rotation device mounted on one side of the playard frame, the rotation device comprising a supporter having two coupling ends detachably mounted to two top corners of the playard frame respectively;

wherein the body is maintained horizontally for supporting the baby when changing from a first using status to a second using status via the rotation device.

2. The diaper changer of claim 1, wherein the rotation device comprises a supporter and a rotator, the rotator connected to the body with one end and rotatably mounted to the supporter with the other end, the supporter mounted on the side of the playard frame, the body rotatable relative to the supporter via the rotator.

3. The diaper changer of claim 2, wherein the rotator comprises a shaft and the supporter comprises a shafting hole, the shaft rotatably mounted within the shafting hole.

4. The diaper changer of claim 2, wherein the supporter comprises a coupling portion and a pipe portion extending from the coupling portion and the rotator comprises a hollow axle portion sleeved on the pipe portion so as to allow the body for rotating relative to the supporter.

5. The diaper changer of claim 4, wherein the supporter further comprises a limiter capable of abutting against the axle portion for limiting relative movement of the axle portion to the pipe portion.

6. The diaper changer of claim 5, wherein the pipe portion is hollow and the limiter is a V-shape elastic element placed in the hollow pipe portion, the elastic element having a protrusion that extends outward the pipe portion for abutting against the wall of the axle portion.

7. The diaper changer of claim 2, wherein the supporter comprises a first engaging device and the rotator comprises a second engaging device for engaging with the first engaging device so that the body is selectively fixed in the first using status or in the second using status relative to the playard frame.

8. The diaper changer of claim 7, wherein the first engaging device is a bulge and the second engaging device is an indentation.

9. The diaper changer of claim 1, wherein the first using status is a position the baby lying with its feet toward a babysitter and the second using status is a position the baby lying laterally toward the babysitter.

10. The diaper changer of claim 1, wherein the playard frame comprises a shafting hole on one side and the rotation device comprises a shaft rotatably mounted within the shafting hole.

11. A playard, comprising:

a playard frame comprising at least two top corners; and a diaper changer, comprising:

a body for supporting a baby; and a rotation device connecting to the body, the rotation device mounted on one side of the playard frame and rotatable along a first direction, the rotation device comprising a supporter having two coupling ends detachably mounted to the two top corners respectively;

wherein the body is capable of selectively set horizontally for supporting the baby either in a first using status or in a second using status relative to the playard frame via the rotation device.

12. The playard of claim 11, wherein the rotation device further comprises a rotator, the rotator connected to the body with one end and rotatably mounted to the supporter with the other end, the supporter mounted on the side of the playard frame, the body rotatable relative to the supporter via the rotator.

13. The playard of claim 12, wherein the rotator comprises a shaft and the supporter comprises a shafting hole, the shaft rotatably mounted within the shafting hole.

14. The playard of claim 12, wherein the supporter comprises a coupling portion and a pipe portion extending from the coupling portion and the rotator comprises a hollow axle portion sleeved on the pipe portion so as to allow the body for rotating relative to the supporter.

15. The diaper changer of claim 14, wherein the rotator further comprises a disk at the bottom of the axle portion, the disk has at least an indentation, and the coupling portion comprises a concave portion for containing the disk and has at least a bulge on the concave portion for engaging with the indentation so that the rotation angle of the body relative to the supporter can be fixed.

16. The playard of claim 11, wherein the first direction is horizontal direction.

17. The playard of claim 11, wherein the playard frame comprises a shafting hole mounted on one side and the rotation device comprises a shaft rotatably inserted in the shafting hole.

18. The playard of claim 11, wherein the first using status is a position the baby lying with its feet toward a babysitter and the second using status is a position the baby lying laterally toward the babysitter.

19. A diaper changer for a playard frame, comprising:

a body for supporting a baby; and a rotation device connecting to the body, the rotation device mounted on one side of the playard frame;

wherein the body is maintained horizontally with a first portion of the body and a second portion of the body located at opposite sides of the playard frame while rotating the body relative to the playard frame via the rotation device, the first portion of the body extending above an outside of the playard frame and the second portion of the body extending above an inside of the playard frame.

20. A diaper changer for a playard frame, comprising:

a body which includes a surface for a baby lying thereon; and a rotation device connecting to the body, the rotation device mounted on one side of the playard frame, the rotation device comprising:

a supporter; and a rotator connected to the body with one end and rotatably mounted to the supporter with the other end, the supporter mounted on the side of the playard frame, and the body rotatable relative to the supporter via the rotator;

wherein the supporter comprises a coupling portion and a pipe portion extending from the coupling portion and the rotator comprises a hollow axle portion sleeved on the pipe portion so as to allow the body to rotate relative to the supporter;

wherein the rotator further comprises a disk at the bottom of the axle portion, the disk has at least an indentation, and the coupling portion comprises a concave portion for containing the disk and has at least a bulge on the concave portion for engaging with the indentation so that the rotation angle of the body relative to the supporter can be fixed;

wherein the body is maintained horizontally for supporting the baby when changing from a first using status to a second using status via the rotation device.

* * * * *